US007223912B2

(12) United States Patent
Nishimoto et al.

(10) Patent No.: US 7,223,912 B2
(45) Date of Patent: May 29, 2007

(54) APPARATUS AND METHOD FOR CONVERTING AND DELIVERING MUSICAL CONTENT OVER A COMMUNICATION NETWORK OR OTHER INFORMATION COMMUNICATION MEDIA

(75) Inventors: Tetsuo Nishimoto, Shizuoka-ken (JP); Kosei Terada, Shizuoka-ken (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 09/864,670

(22) Filed: May 24, 2001

(65) Prior Publication Data

US 2002/0000156 A1 Jan. 3, 2002

(30) Foreign Application Priority Data

May 30, 2000 (JP) ..... 2000-159694
Jun. 8, 2000 (JP) ..... 2000-172514

(51) Int. Cl.
*G04B 13/00* (2006.01)
*G10H 7/00* (2006.01)

(52) U.S. Cl. ..... 84/609; 84/610; 84/649; 84/650; 84/477 R; 84/478

(58) Field of Classification Search ..... 84/609–614, 84/649–652, 477 R, 478; 434/307 A
See application file for complete search history.

(56) References Cited

U.S. PATENT DOCUMENTS 4,926,737 A 5/1990 Minamitaka
5,736,663 A 4/1998 Aoki et al.
5,763,802 A 6/1998 Aoki et al.
5,886,274 A 3/1999 Jungleib
5,929,359 A * 7/1999 Sone et al. ..... 84/610
6,062,868 A * 5/2000 Toriumi ..... 84/609 X
6,072,113 A * 6/2000 Tohgi et al. ..... 84/609 X
6,211,453 B1 * 4/2001 Kurakake ..... 84/609
6,267,600 B1 * 7/2001 Song ..... 84/610 X
6,392,134 B2 * 5/2002 Aoki ..... 84/609
6,570,080 B1 * 5/2003 Hasegawa et al. ..... 84/609

FOREIGN PATENT DOCUMENTS

EP 0 837 451 A1 4/1998
JP HEI10-150505 6/1998
JP HIE10-275186 10/1998
JP HEI11-120198 4/1999
JP HEI11-242490 9/1999

* cited by examiner

*Primary Examiner*—Marlon Fletcher
(74) *Attorney, Agent, or Firm*—Morrison & Foerster LLP

(57) ABSTRACT

User enters information of a melody or other musical material and, when necessary, desired parameters. The input information and parameters are transmitted to a server via a network or other communication media. On the basis of the received musical material and parameters, the server creates content by imparting the musical material with an additional value corresponding to the parameters. For example, in the case where the musical material is a melody of a music piece, the server creates, as the content, harmony information, backing information, accompaniment information, musical score picture information, or the like. There may also be created test-listening or test-viewing sample content corresponding to the regular content. The user receives the sample content from the server, and purchases the regular content when the sample content has been found to be satisfactory as a result of the test listening or test viewing.

17 Claims, 12 Drawing Sheets

PARAMETER 2 INPUT SCREEN

【 INPUT METHOD 】

● INPUT NOTES WHILE VIEWING MUSICAL SCORE

○ INPUT NOTES IN NUMERICAL VALUES

○ INPUT HUMMING

○ LOAD SMF

○ SELECT FROM MELODY DATABASE

OK CANCEL

MELODY INPUT SCREEN

F I G. 4

【 PARAMETER 1 】

< TYPE >

☐ IMPART HARMONIES

☐ IMPART CHORDS

■ CREATE LEFT-HAND PERFORMANCE, WITH MELODY ASSUMED TO BE PERFORMED BY RIGHT HAND

☐ CREATE BOTH-HAND PERFORMANCE SUITED TO MELODY

☐ CREATE BACKING PERFORMANCE

☐ IMPART EXPRESSION

☐ AUTOMATICALLY COMPOSE SINGLE MUSIC PIECE

☐ MODIFY MELODY

☐ CREATE MIDI DATA FROM WAVEFORM

■ CREATE MUSICAL SCORE

OK CANCEL

PARAMETER 1 INPUT SCREEN

F I G. 5

APPARATUS AND METHOD FOR CONVERTING AND DELIVERING MUSICAL CONTENT OVER A COMMUNICATION NETWORK OR OTHER INFORMATION COMMUNICATION MEDIA

BACKGROUND OF THE INVENTION

The present invention relates to an improved content generation service system, method and storage medium for converting and delivering musical content between a client terminal and a server via a communication network or other information communication media.

There have been known apparatus which are designed to generate an additional-value-imparted musical data by performing various processes on melody data input by a user, such as processes for imparting harmonies, chords and accompaniment to the user-input melody data. If a user's information processing terminal is equipped with such a function of generating additional-value-imparted musical data, then the information processing terminal would unavoidably become complicated in construction. Particularly, if the user's information processing terminal is in the form of a small-size apparatus such as a portable communication terminal, it is likely that the processing terminal can not be even equipped with the musical data generating function due to limits of hardware and storage capacity allocatable to necessary processing programs.

SUMMARY OF THE INVENTION

In view of the foregoing, it is an object of the present invention to provide a content generation service system which, via a communication network or other information communication media, can readily generate additional-value-imparted musical content with respect to musical material content, such as a melody, input by a user.

It is another object of the present invention to provide a content generation service system which, via a communication network or other information communication media, can readily generate musical content, such as a melody, on the basis of parameter information, such as melody generating parameters, input by a user.

According to a first aspect of the present invention, there is provided a client terminal apparatus for generating content, which comprises: an input device adapted to input melody information to the client terminal apparatus; a transmitter coupled with the input device and adapted to transmit the melody information, inputted via the input device, to a server; and a receiver adapted to receive, from the server, content information created by imparting an additional value to the melody information transmitted via the transmitter to the server.

The present invention also provides a server apparatus for generating content for use in correspondence with the above-mentioned client terminal apparatus, which comprises: a receiver adapted to receive melody information from a client terminal; a processor device coupled with the receiver and adapted to create content information by imparting an additional value to the melody information received via the receiver; and a delivery device coupled with the processor device and adapted to deliver, to the client terminal, the content information created by the processor device.

According to another aspect of the present invention, there is provided a client terminal apparatus for generating content, which comprises: an input device adapted to input musical material information to the client terminal apparatus, the musical material information being representative of a musical material, other than a melody, of a music piece; a transmitter coupled with the input device and adapted to transmit the musical material information, inputted via the input device, to a server; and a receiver adapted to receive, from the server, content information created by imparting an additional value to the musical material melody transmitted via the transmitter to the server.

The present invention also provides a server apparatus for generating content for use in correspondence with the above-mentioned client terminal apparatus, which comprises: a receiver adapted to receive musical material information from a client terminal, the musical material information being representative of a musical material, other than a melody, of a music piece; a processor device coupled with the receiver and adapted to create content information by imparting an additional value to the musical material information received via the receiver; and a delivery device coupled with the processor device and adapted to deliver, to the client terminal, the content information created by the processor device.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described hereinbelow represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIG. 4 is a diagram showing an example of a melody input screen shown on a display device of a client terminal in the embodiment of the content generation service system;

FIG. 5 is a diagram showing an example of a "Parameter 1" (additional-value designating parameter) input screen displayed on the client terminal in the embodiment of the content generation service system;

DETAILED DESCRIPTION OF EMBODIMENTS

Figure 1:
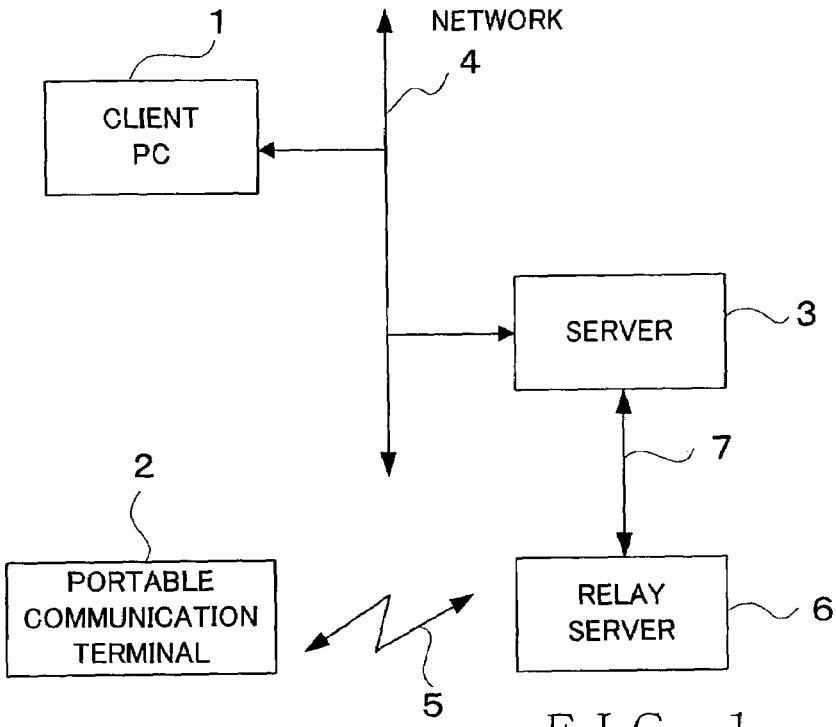
FIG. 1 is a block diagram showing an exemplary general setup of a content generation service system in accordance with an embodiment of the present invention.

Before going into detailed description of the embodiments of the present invention, several important aspects of the embodiments are outlined below. Namely, a client terminal apparatus in accordance with the first aspect comprises: an input device adapted to input melody information to the client terminal apparatus; a transmitter coupled with the input device and adapted to transmit the input melody information to a server; and a receiver adapted to receive, from the server, content information created by imparting an additional value to the melody information transmitted to the server. Server apparatus for generating content which can be employed in correspondence with the above-mentioned client terminal apparatus comprises: a receiver adapted to receive melody information from a client terminal; a processor device coupled with the receiver and adapted to create content information by imparting an additional value to the received melody information; and a delivery device coupled with the processor device and adapted to deliver, to the client terminal, the content information created by the processor device. In this case, the information to be transmitted from the client terminal to the server may be musical material information representative of a musical material other than the melody.

According to the first aspect, original melody information is input, as the musical material information, via the client terminal like a client personal computer (PC) or portable communication terminal and then transmitted to a server, so that the server generates music piece data or musical composition data by imparting an additional value to the original melody information and delivers the thus-generated music piece data (additional-value-imparted data) to the client terminal. With such an arrangement, the present invention allows a user of the client terminal to obtain additional-value-imparted content without having to complicate the structure of the client terminal.

According to the second aspect, the content information received via the receiver in the client terminal apparatus is sample content information that is intended for test listening or test viewing by the user, the transmitter is further adapted to transmit, to the server, a request for delivery of regular content information, and the receiver is further adapted to receive the regular content information delivered from the server in response to the request for delivery. In one embodiment of the server apparatus corresponding to the client terminal apparatus, the processor device is adapted to create regular content information and sample content information that is intended for test listening or test viewing, and the delivery device delivers, to the client terminal, the sample content information created by the processor device, and then, in response to a request for delivery of the regular content information by the client terminal, delivers, to the client terminal, the regular content information created by the processor device.

In the second aspect, the server is arranged to generate both the regular content and the sample content consisting of test-listening or test-viewing content, and the client terminal is arranged to allow the user to test-listen or test-view the test-listening or test-viewing content and obtain the regular content (additional-value-imparted data) only when the user has found the sample content to be satisfactory as a result of the test listening or test viewing. Thus, in case the sample content generated and delivered by the server has been found unsatisfactory, the user can choose to not obtain the regular content; that is, the user can be effectively prevented from obtaining the corresponding regular content by mistake.

Outlining the third aspect, one embodiment of the input device is further adapted to input parameter information to the client terminal apparatus, the transmitter is further adapted to transmit the input parameter information to the server, and the receiver is further adapted to receive, from the server, content information having an additional value corresponding to the parameter information transmitted to the server. In one embodiment of the server apparatus corresponding to the client terminal apparatus, the receiver is further adapted to receive parameter information from the client terminal, and the processor device is adapted to create content information having an additional value corresponding to the received parameter information.

According to the third embodiment, content generating parameters (parameter information) are input, along with musical material information (original melody information), from the client terminal, and the server is arranged to generate content on the basis of the musical material information (original melody information) and content generating parameters (parameter information). Thus, the user of the client terminal can control the substance of the content to be generated.

Outlining the fourth aspect, the content information created by the processor device and having the additional value imparted thereto includes at least one of: harmony information matching with the received melody information; backing information matching with the received melody information; left-hand performance information matching with the received melody information, with the received melody information assumed to be performance information generated through a performance on a keyboard-based musical instrument by a right hand; both-hand performance information matching with the received melody information; performance expression information for the received melody information; musical composition information of a single music piece with the received melody information used as a motif thereof; other melody information made by modifying the received melody information; information made by converting waveform data of the received melody information into tone-generator driving information of a predetermined format; and musical score picture information corresponding to at least one of the information listed above.

According to the fourth aspect, the server apparatus is arranged in such a manner that when the melody generating parameters (parameter information) are input from the client terminal and transmitted to the server, the server generates musical content, such as a melody, on the basis of the melody generating parameters (parameter information) from the client terminal and delivers the thus-generated musical content to the client terminal. With this arrangement, the user of the client terminal can readily obtain musical content.

Specific embodiments of the present invention will be described in detail hereinbelow with reference to the drawings. It should be appreciated that the embodiments described hereinbelow are just for illustrative purposes and may be modified variously without departing from the spirit of the present invention.

<System Configuration>

FIG. 1 is a block diagram showing an exemplary general setup of a content generation service system in accordance with an embodiment of the present invention. This content generation service system includes client terminals such as a client personal computer (OC) 1 and a portable communication terminal 2, and a server 3 that carries out a process corresponding to a request given from any one of the client terminals. The client personal computer 1 is connected via a communication network 4 to the server 3 for bidirectional communication therewith, and the portable communication terminal 2 is connected via a terminal communication line 5, relay server 6 and relay communication network 7 to the server 3 for bidirectional communication therewith.

The client personal computer 1 is an information processing terminal having a predetermined information communication function and musical data processing function. The client personal computer 1 may be a special-purpose terminal, such as an electronic musical instrument, music training apparatus, karaoke apparatus or electronic game apparatus, as long as it has the predetermined information communication function and information processing function. The portable communication terminal 2 is a communication terminal, such as a cellular phone, having a predetermined information processing function. Further, the relay server 6 relays signal transmission/reception between the portable communication terminal 2 and the server 3. The server 3 receives a request from the client terminal 1 or 2 via the communication network 4 or the terminal communication line 5, relay server 6 and relay communication network 7, carries out a process corresponding to the received request from the client terminal 1 or 2, and then delivers results of the processing to the client terminal 1 or 2.

Figure 2:
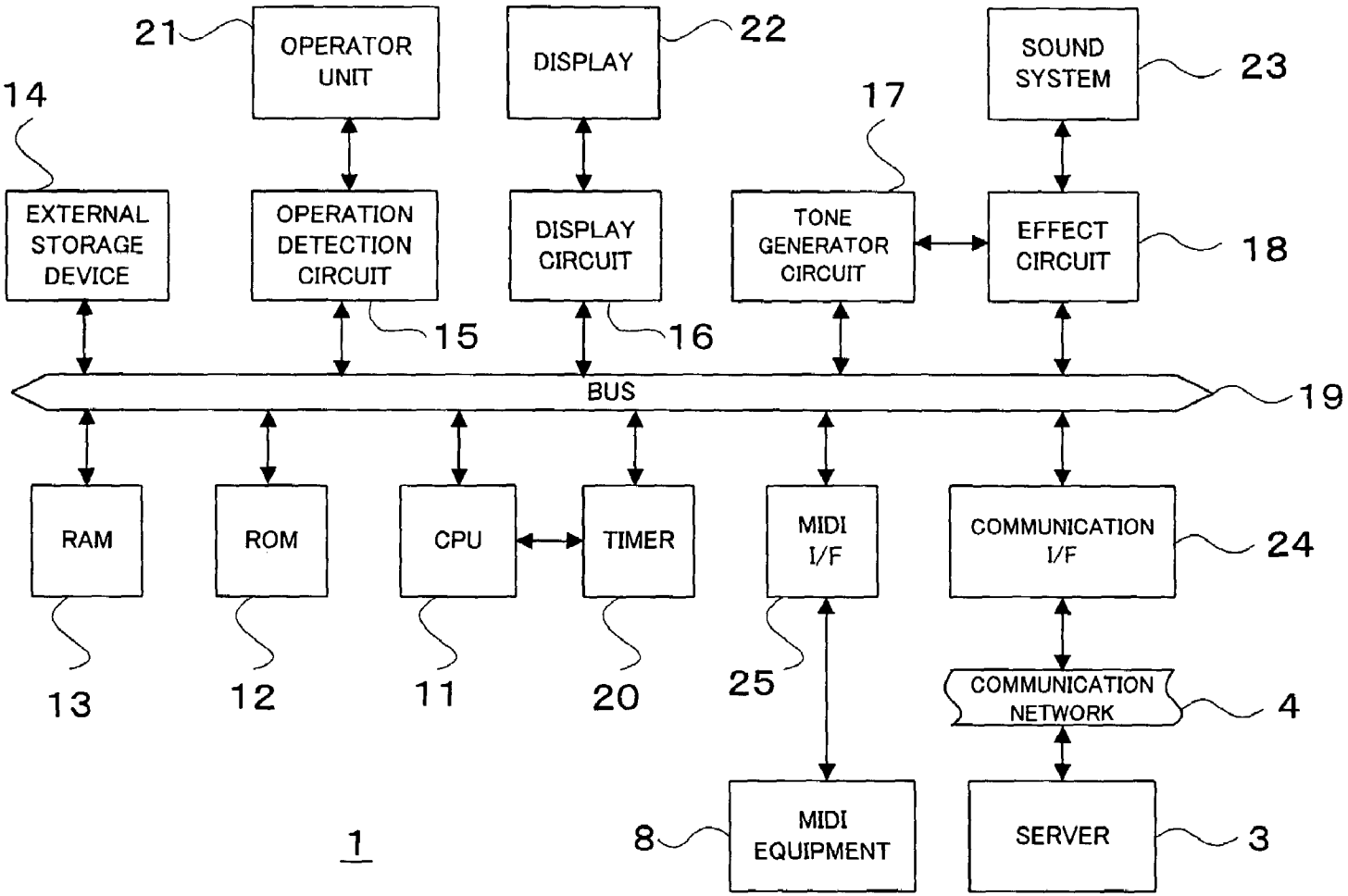
FIG. 2 is a block diagram showing an exemplary hardware setup of a client personal computer in the content generation service system of FIG. 1.

FIG. 2 is a block diagram showing an exemplary hardware setup of the client personal computer 1. In the illustrated example of FIG. 2, the client personal computer 1 includes a central processing unit (CPU) 11, a read-only memory (ROM) 12, a random-access memory (RAM) 13, an external storage device 14, an operation detection circuit 15, a display circuit 16, a tone generator circuit 17, and an effect circuit 18. These components 11–18 of the client personal computer 1 are connected with each other via a bus 19 and the client personal computer 1 has a function of processing musical data in addition to an ordinary data processing function.

The CPU 11 of the client personal computer 1 controls operations of the entire client personal computer 1, and is connected with a timer 20 that is used to generate interrupt clock pulses or tempo clock pulses. The CPU 11 executes various control in accordance with predetermined programs. The ROM 12 has stored therein predetermined control programs for controlling the client personal computer 1, which may include control programs for basic information processing, musical data processing programs and other application programs, as well as various tables and data. The RAM 13 stores therein necessary data and parameters for these processes, and is also used as various registers, flags and a working memory for temporarily storing various data being processed.

The external storage device 14 comprises one or more of various transportable (removal) storage media, such as a hard disk drive (HDD), compact disk read-only memory (CD-ROM), floppy disk (FD), magneto-optical (MO) disk, digital versatile disk (DVD) and memory card, and is capable of storing various control programs and data. Thus, the programs and data necessary for the various processes can be stored not only in the ROM 12 but also in the external storage device 14 as appropriate; in the latter case, any desired program and data can be read from the external storage device 14 into the RAM 13, and processed results can be recorded onto the external storage device 14 as necessary.

The operation detection circuit 15 is connected with an operator unit 21 including various operators such as a keyboard, switches and a pointing device like a mouse, via which a user of the client personal computer 1 can input, to the client personal computer 1, information based on manipulation of any one of the operators on the operator unit 21. In this case, by allocating particular ones of the operators to performance operation on a musical instrument's keyboard or the like, it is possible to input musical data to the client personal computer 1. The display circuit 16 is connected with a display device 22, on which can be visually shown buttons operable by the user via the pointing device or other operator. Further, a sound system 23 connected with the effect circuit 18 that may comprise a DSP and the like constitutes, along with the tone generator circuit 17 and effect circuit 18, a sound output section capable of generating a tone.

To the bus 19 is connected a communication interface 24, so that the client personal computer 1 is connected, via the communication interface 24 and communication network 4, with the server 3 for bidirectional communication therewith. This way, the client personal computer 1 can request the server 3 to perform a predetermined process, or receive from the server 3 various information including musical content so as to store the received various information into the external storage device 14. In the illustrated example of FIG.

2, a MIDI interface (I/F) 25 is also connected to the bus 19 so that the client personal computer 1 can communicate with other MIDI equipment 8.

Note that the portable communication terminal 2 and the server 3 each have a hardware setup substantially similar to that illustrated in FIG. 2. However, the portable communication terminal 2 may not include (may dispense with) the MIDI interface (I/F) 25 and effect circuit 18, although it does include the tone generator circuit 17. Further, the server 3 may not include (may dispense with) the MIDI interface (I/F) 25, tone generator circuit 17 and effect circuit 18.

<Outline of System's Functions>

Figure 3:
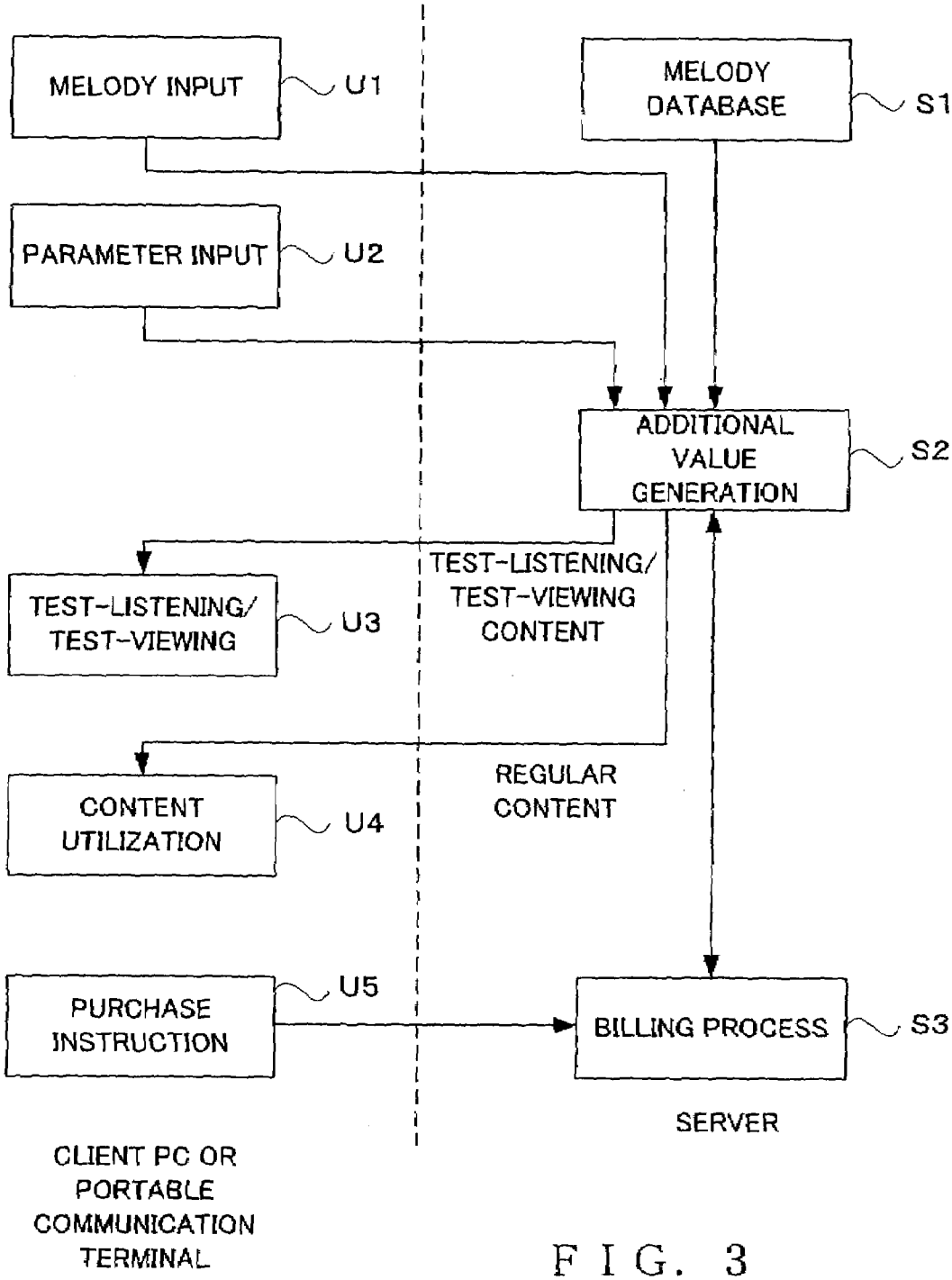
FIG. 3 is a block diagram outlining various functions performed by the content generation service system of FIG. 1.

FIG. 3 is a block diagram outlining various functions of the content generation service system in accordance with one embodiment of the present invention. Functionally, the client terminals, such as the client personal computer 1 and portable communication terminal 2, each include a melody input section U1, a parameter input section U2, a test-listening/test-viewing section U3, a content utilization section U4, and a purchase instruction section U5. The server 3 includes a melody database section S1, an additional value generation section S2, and a billing section S3.

In the content generation service system of FIG. 3, musical material information, such as melody information (original melody), and parameters (control data) are first input from the client terminal, such as the client personal computer 1 or portable communication terminal 2, by means of the melody input section U1 and parameter input section U2 and then transmitted to the server 3. In turn, the server 3 generates music piece data having an additional value corresponding to the parameters (control data) with respect to the original melody (musical material information), and delivers the thus-generated music piece data as musical content (additional-value-imparted data) to the client terminal 1 or 2, by means of the additional value generation section S2. At that time, the additional value generation section S2 generates test-listening or test-viewing content (samples data) in addition to the regular musical content, and delivers the test-listening or test-viewing content to the client terminal 1 or 2. Then, upon confirming receipt of a purchase request issued from the purchase instruction section U5 as a result of test-listening or test-viewing operation by the section U3, the billing section S3 of the server 3 performs a billing process, and then the additional value generation section S2 makes arrangements to deliver the regular musical content (additional-value-imparted data) to the requesting client terminal 1 or 2.

More specifically, in the client terminal 1 or 2, the melody input section U1 inputs melody information to which an additional value is to be imparted, using a guide screen (window) on the display device 22 and in any one of various melody information input methods such as those enumerated in items (1) to (5) below. The melody information input methods of items (1) to (4) are each designed to input melody data themselves, while the melody information input method of item (5) is designed to merely specify melody designation data (e.g., melody number).

(1) Note data are input by the user instructing contents of a musical score while viewing a displayed musical score, such as a staff or piano roll, on the display device 22.

(2) Notes are input in numerical value (code) data by the user designating tone pitches and duration via operator switches of the operator unit 21, such as a ten-button keypad.

(3) Existing music piece data (SMF: Standard MIDI File) are input by being loaded from the external storage device 14 or the like.

(4) Humming or performance on a musical instrument is recorded in advance, and then waveform data of the recorded humming or musical instrument performance are input.

(5) Desired music piece is selected from among a plurality of music pieces stored in the melody database section S1 of the server 3; in this case, the billing process is carried out in the server 3 in accordance with the selected music piece).

Any other suitable method than the above-mentioned five melody information input methods may be employed; for example, melody information of an automatically composed music piece may be input, or melody information may be input by the user receiving a melody attached to an electronic mail from another client terminal.

FIG. 4 shows an example of a melody input screen (window) shown on the display device 22 of the client terminal. In the illustrated example, operation buttons "●" and "○" are so-called "radio buttons", via which only one of items listed on the melody input screen can be selected. As the user selects one of the radio buttons through manipulation of the operator unit 21, the one radio button changes from the non-selected state "○" to the selected state "●". Then, by activating or clicking an "OK" button at the bottom of the melody input screen, the melody input screen changes to a melody data input screen (not shown) corresponding to the selected radio button or user-selected input method.

Using the guide screen (window) on the display device 22, the parameter input section U2 inputs additional-value designating parameters indicative of particular types of additional value data to be generated and additional-value-data generating parameters indicative of parameters necessary for generation of the additional value data, with respect to the input melody. For example, the additional-value designating parameters (Parameter 1) include parameters indicating the following types of additional value data (1) for imparting harmonies, (2) for imparting chords, (3) for creating a left-hand performance, with the input melody assumed to be performed by the right hand, (4) for creating a both-hand accompaniment suited to the input melody, (5) for creating a backing performance, (6) for imparting performance expression, (7) for automatically composing a single complete music piece, (8) for modifying the input melody, (9) for creating MIDI data from a waveform of the input melody, and

(10) for creating a musical score.

The additional-value-data generating parameters (Parameter 2) include "Difficulty Level" parameters indicative of a beginner's (introductory) level, intermediate level and advanced level, "Style" parameters indicative of impartment of rendition styles, such as an arpeggio, to the melody, and "Intro/Ending" parameters indicative of impartment of intro and ending sections to the input melody.

Figure 6:
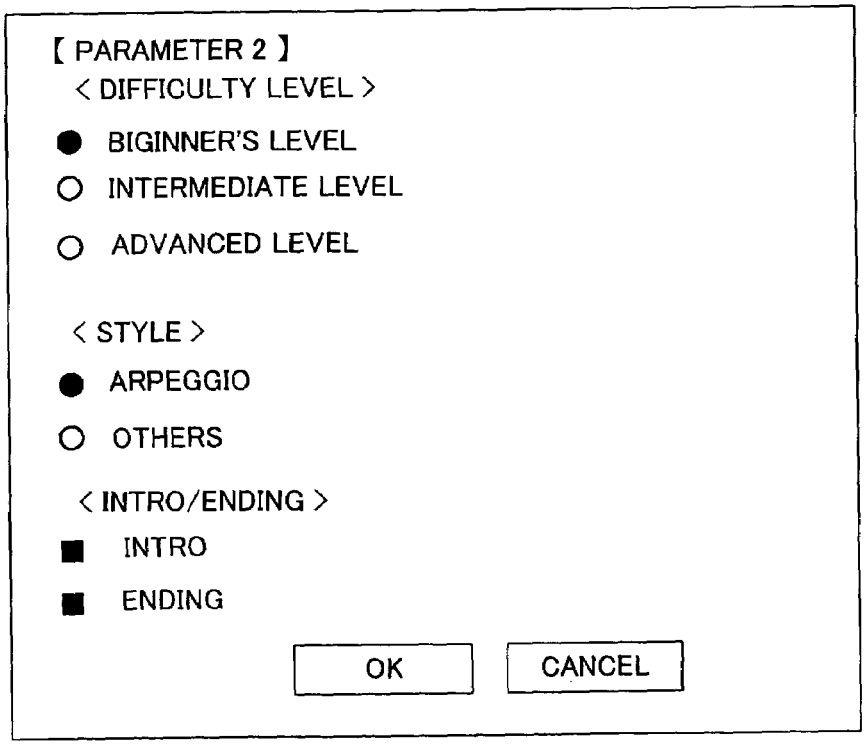
FIG. 6 is a diagram showing an example of a "Parameter 2" (additional-value-data generating parameter) input screen displayed on the client terminal in the embodiment of the content generation service system.

FIGS. 5 and 6 show examples of an additional-value designating parameter input screen (window) and additional-value-data generating parameter input screen (window), respectively. More specifically, FIG. 5 shows an example of the additional-value designating parameter input screen as a "Parameter 1" input screen via which the user is allowed to select at least one desired type of additional value, while FIG. 6 shows an example of the additional-value-data generating parameter input screen as a "Parameter 2" input screen via which the user is allowed to enter various parameters necessary for generation of the selected additional value. Note that operation buttons "●" and "○" on the "Parameter 2" input screen of FIG. 6 are "radio buttons", via which only one of listed items can be selected, as with the melody input screen of FIG. 4. Operation buttons "□" and "■" are so-called "check buttons", via which any desired number of items can be selected from among listed items. Further, when "Other" is selected in the "Style" selection section of FIG. 6, a plurality of rendition styles (except for arpeggio) at a lower hierarchical level corresponding to the selected item "Other" are displayed, although not specifically shown in FIG. 6.

On the "Parameter 1" input screen of FIG. 5, the user selects at least one type of additional value data to be generated. In the illustrated example of FIG. 5, selections have been made for "creating a left-hand performance with the input melody assumed to be performed by the right hand" and "creating a musical score". In response to the user selections on the "Parameter 1" input screen, the server 3 is caused to create music piece data comprising a right-hand performance part (i.e., input melody part) and a left-hand performance part suited to the right-hand performance part, as well as musical score data corresponding to the created music piece data.

On the "Parameter 2" input screen of FIG. 6, the user enters various parameters necessary for creating music piece data of the left-hand performance part in response to the selective designation on the "Parameter 1" input screen of FIG. 5. In the illustrated example of FIG. 6, selections have been made for setting the difficulty level to the "Beginner's Level" and the rendition style to "Arpeggio" and for imparting "Intro" and "Ending" sections to the melody. In response to the selections on the "Parameter 2" input screen, the server 3 is caused to create music piece data and corresponding musical score data of the beginner's level in such a way that an arpeggio is imparted as the rendition style and intro and ending sections are imparted to the melody.

As an example, the melody input section U1 and parameter input section U2 of the client terminal 1 or 2 may input a melody and parameters via a Web browser using the Internet. Namely, when the user enters a melody and requests creation of accompaniment data and musical score data on input screens as illustrated in FIGS. 4 to 6 via the Web browser, the melody information is transmitted, along with the request for creation of accompaniment data and musical score, to the Web server 3. In turn, the Web server 3 imparts an accompaniment to the input melody, creates a musical score representing the input melody and then sends the accompaniment-imparted melody and musical score to the user.

Namely, the melody (melody data or melody designating data) entered via the melody input section U1 of the client terminal 1 or 2, and the parameters (additional-value designating parameters and additional-value-data generating parameters) entered via the parameter input section U2 are transmitted to the additional value generation section S2 of the server 3. Then, the additional value generation section S2 imparts an additional value to the input melody in accordance with the input melody and parameters received from the client terminal 1 or 2. More specifically, the additional value generation section S2 performs its additional-value generation process function to impart the input melody with additional value data corresponding to the additional-value designating parameters and additional-value-data generating parameters designated via the parameter input section U2 of the client terminal 1 or 2.

Namely, for the additional value impartment, the additional value generation section S2 generates two sorts of content, i.e. regular content and test-listening or test-viewing content. For example, the test-listening or test-viewing content related to the music piece data may be partial music piece data representative of only part of the music piece or lower-quality music piece data having a lower quality than the regular music piece data, while the test-listening or test-viewing content related to the musical score data may be partial musical score data representative of only part of the musical score or sample musical score data labeled "for test listening". Note that the test-listening content, which generally comprises the same data as the regular content, may be built in a format that, by the streaming or like technique, allows no data to remain in the client personal computer 1 or portable communication terminal 2.

After having generated such additional value data, the additional value generation section S2 of the server 3 first delivers the test-listening or test-viewing content (i.e., sample content) to the client terminal 1 or 2. The client terminal 1 or 2, having received the test-listening or test-viewing content from the additional value generation section S2 of the server 3, can listen to or view the test-listening or test-viewing content through the function of the test-listening/test-viewing section U3 and can thereby determine whether the regular content corresponding to the sample content should be purchased or not. If the user of the client terminal 1 or 2 has decided to purchase the regular content as a result of the test listening or test viewing via the section U4, the purchase instruction section U5 issues a purchase request for the regular content to the server 3. Once the billing section S3 of the server 3 confirms the regular content purchase request given from the client terminal 1 or 2, it performs the billing process to bill the user for the content to be purchased and, upon completion of the billing process, the server 3 causes the additional value generation section S2 to deliver the regular content to the client terminal 1 or 2.

In the client terminal 1 or 2 having received the regular content from the server 3, the content utilization section U4 makes use of the purchased regular content. Form of the utilization of the purchased regular content differs depending on the nature of the content. Namely, if the purchased regular content is music piece data, it may, for example, be reproduced for listening, transmitted to a third party by being attached to an e-mail, used in the portable communication terminal 2 or the like as an incoming-call alerting melody or BGM, or saved in the external storage device 14 or the like for creation of a library. If the purchased regular content is musical score data, it may, for example, be printed by a printer (not shown), or visually shown on the display device 22. Alternatively, the regular content may be used in a music training apparatus, or used as a karaoke accompaniment or as BGM of an electronic game.

The billing section S3 of the server 3 may charge an uniform amount of money for every content or a different amount of money for each type of content. Further, the amount of money to be paid may be reduced depending on the number of times content purchase has been so far made by the user or the number of contents so far purchased by the user. The payment responsive to the billing by the server 3 may be made in any suitable manner; for example, the amount of money may be paid by a credit card, bank account transfer, postal transfer or electronic money, or may be added to a bill for the portable communication terminal used by the user.

In a situation where the regular content is to be delivered from the server 3 to a previously-registered client terminal, it is preferable that the regular content delivery be effected when the billing process has been completed in response to confirmation of the purchase request. However, in a case where the payment for the regular content is by bank account transfer or postal transfer, the regular content may be delivered after the payment has been completed. Further, in stead of being delivered via a communication network as noted above, the regular content may be recorded in a storage medium and sent to the client terminal 1 or 2 by mailing of the storage medium storing the regular content. Also note that user information necessary for the billing process may be registered in the billing section S3 of the server 3 in advance or in response to entry of a desired melody and parameters by the user.

<Processing by the Additional Value Generation Section>

Figure 7:
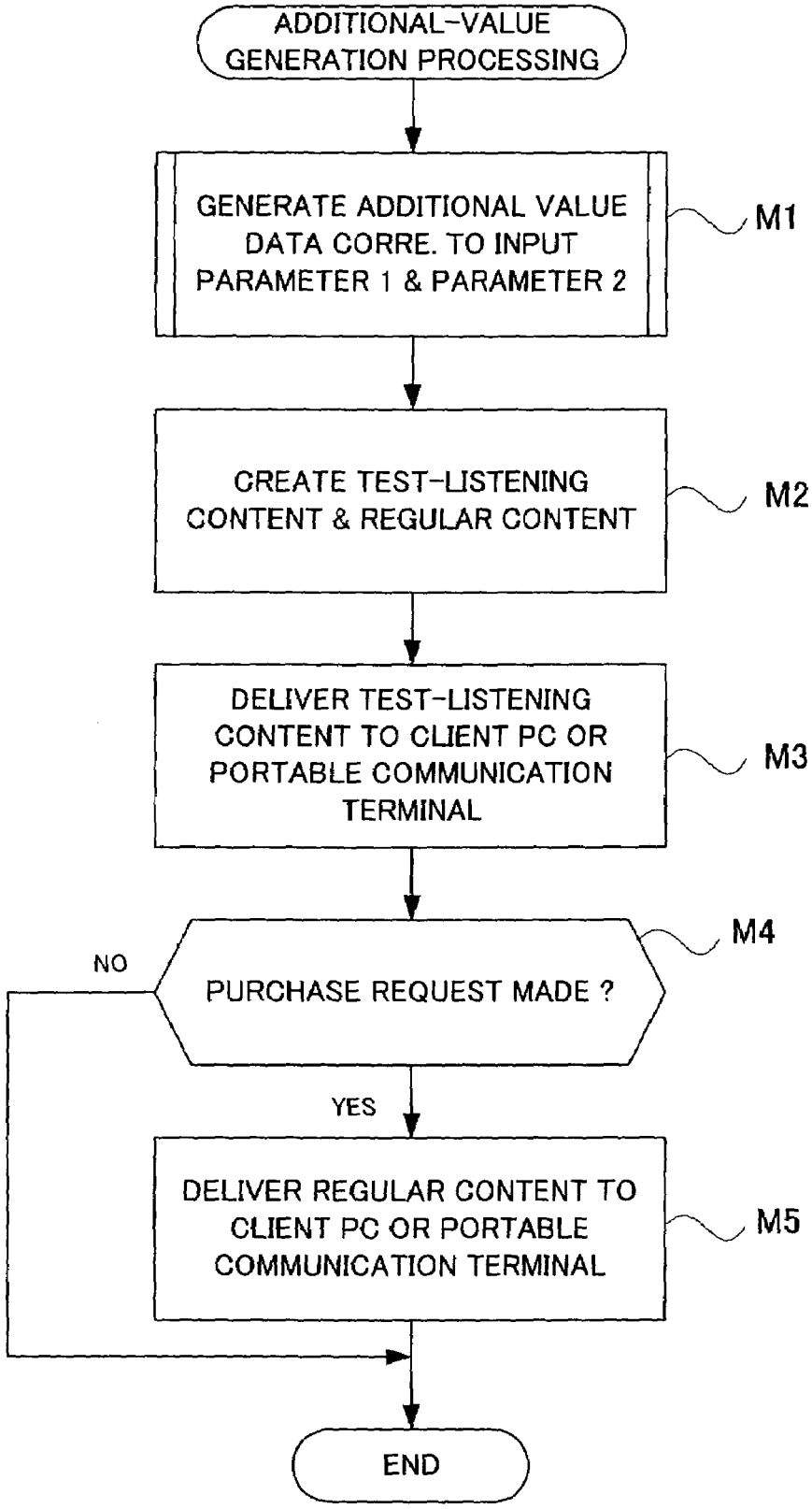
FIG. 7 is a flow chart showing an example of additional-value generation processing executed by an additional value generation section of a server in the embodiment of the content generation service system.

FIG. 7 is a flow chart showing an example of additional-value generation processing executed by the additional value generation section S2 of the server 3 in the instant embodiment. At first step M1 of the additional-value generation processing, additional value data are generated in accordance with selected items on the "Parameter 1" input screen (i.e., additional-value designating parameters) and on the "Parameter 2" input screen (i.e., additional-value-data generating parameters). Note that the additional value data generation need not necessarily be performed fully automatically; that is, a part of the additional value data generation process may be performed manually.

The additional value data generation process at step M1 includes any of the following operations corresponding to additional-value designating parameters (1)–(10) mentioned above, which are carried out in accordance with the additional-value-data generating parameters entered on the "Parameter 2" input screen:

(1) harmony impartment operation for imparting harmonies matching with the input melody;

(2) chord impartment operation for imparting names of chords matching with the input melody;

(3) left-hand accompaniment impartment operation for setting the input melody as a right-hand performance part and imparting a left-hand performance part matching with the melody or right-hand performance part;

(4) both-hand accompaniment impartment operation for imparting a both-hand accompaniment matching with the input melody;

(5) backing impartment operation for imparting rhythm, bass and chord backing (band performance) matching with the input melody;

(6) performance expression impartment operation for imparting performance expression to the input melody;

(7) automatic composition operation for generating a melody of a single complete music piece using the input melody as a motif;

(8) melody modification operation for generating another melody analogous to the input melody;

(9) waveform-to-MIDI conversion operation for generating tone generator driving information of a predetermined format, such as the MIDI format, corresponding to the input waveform data of the melody; and

(10) musical score creation operation for converting, into musical score data, musical data having an additional value imparted by any one of the operations of items (1) to (10) listed above.

Once the additional value data are generated at step M1, the processing proceeds to step M2 in order to create test-listening or test-viewing content and regular content corresponding to the generated additional value data. At next step M3, the test-listening or test-viewing content is delivered to the client personal computer 1 or portable communication terminal 2.

At following step M4, a determination is made as to whether the client personal computer 1 or portable communication terminal 2 has made a purchase request for the regular content. With an affirmative determination at step M4, the processing moves on to step M5, while with a negative answer at step M4, the additional value data generation section S2 terminates the processing. At step M5, the regular content is delivered to the client personal computer 1 or portable communication terminal 2, after which the additional value data generation section S2 terminates the processing.

Now, more details of the additional value data generation at step M1 are set forth below. When the user of the client personal computer 1 or portable communication terminal 2 has entered a desired melody in accordance with the guide display of FIG. 4, selected desired ones of the additional-value designating parameters on the "Parameter 1" input screen of FIG. 5 and desired ones of the additional-value-data generating parameters on the "Parameter 2" input screen of FIG. 6 and then transmits these melody and parameter information to the server 3, the additional value generation section S2 of the server 3 carries out any of the following operations (1) to (10) which corresponds to the transmitted information.

Figure 8:
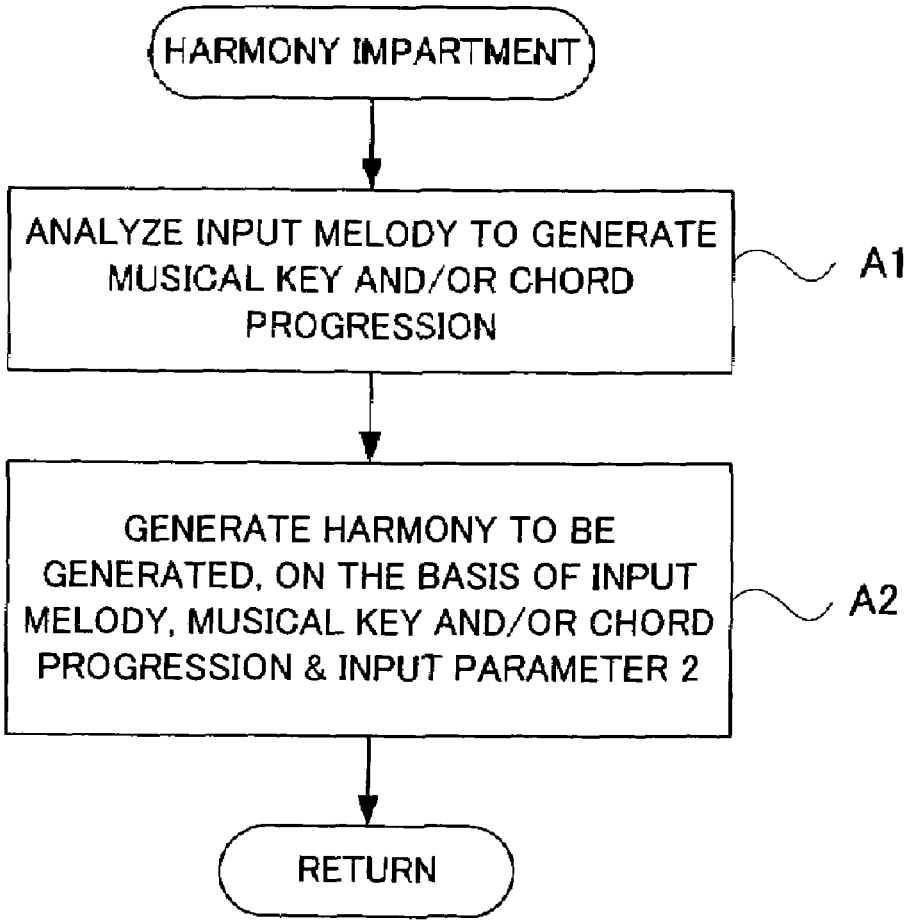
FIG. 8 is a flow chart showing an example of a harmony impartment operation carried out by the additional value generation section.

(1) Harmony Impartment Operation:

FIG. 8 is a flow chart showing an example of the harmony impartment operation carried out by the additional value generation section S2 of the server 3. At first step Al of the harmony impartment operation, the input melody is analyzed so as to generate data indicative of a musical key and/or chord progression of the input melody. At next step A2, harmony data indicative of harmonies to be imparted to the input melodies (e.g., the number of harmony tones, ups and downs of the harmony tones relative to the melody tones, musical intervals (distances), volume and color of the harmony tones, etc.) are generated, on the basis of the input melody, generated musical key data and/or chord progression data and additional-value-data generating parameters input on the "Parameter 2" input screen. After completion of step A2, control returns to step M2 of the additional-value generation processing of FIG. 7. Thus, with the harmony impartment operation, it is possible to impart harmonies appropriate to the input melody (main melody).

Figure 9:
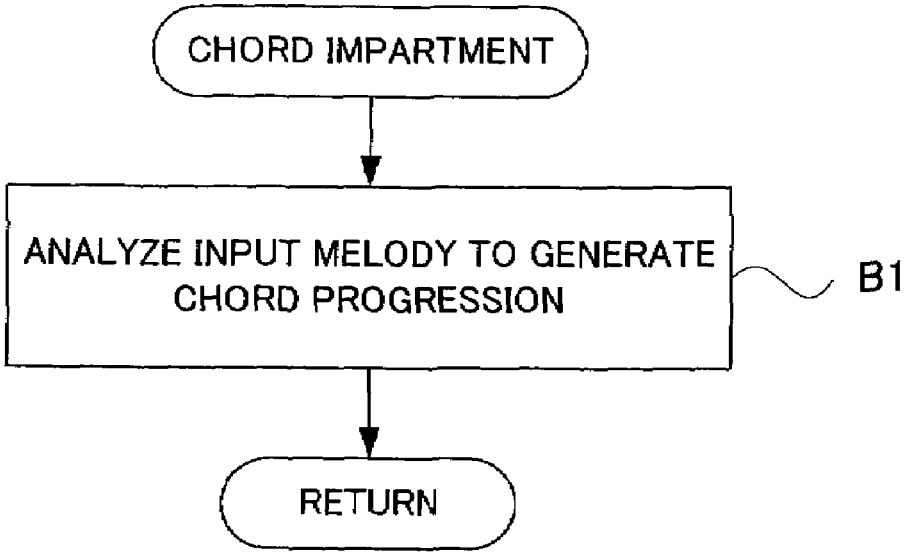
FIG. 9 is a flow chart showing an example of a chord impartment operation carried out by the additional value generation section.

(2) Chord Impartment Operation:

FIG. 9 is a flow chart showing an example of the chord impartment operation carried out by the additional value generation section S2. In this chord impartment operation, the input melody is analyzed at step B1 so as to generate data indicative of the chord progression of the input melody, so that names of appropriate chords (chord progression data) can be imparted to the input melody.

Figure 10:
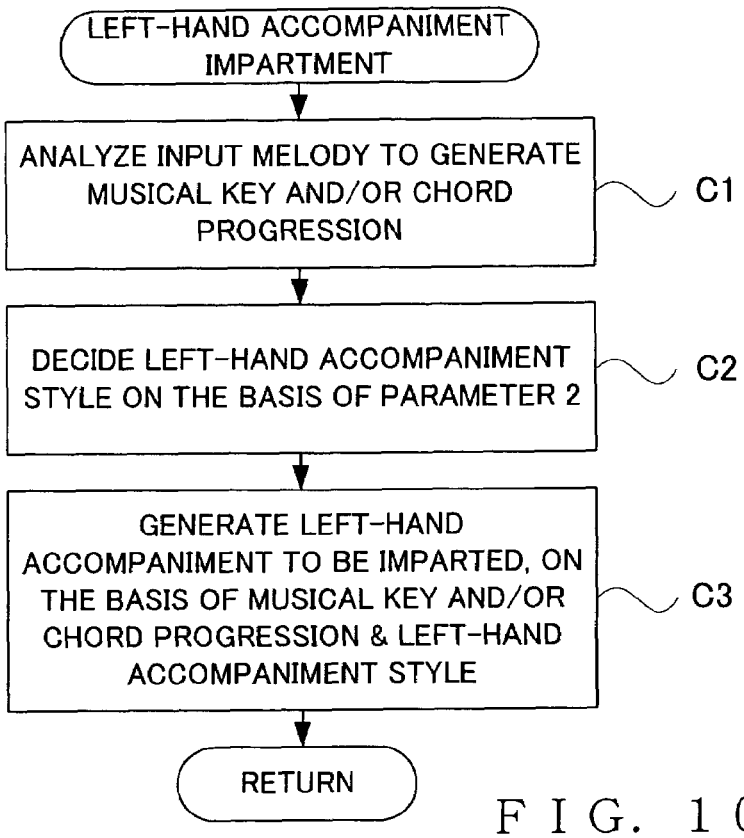
FIG. 10 is a flow chart showing an example of a left-hand accompaniment impartment operation carried out by the additional value generation section.

(3) Left-hand Accompaniment Impartment Operation:

FIG. 10 is a flow chart showing an example of the left-hand accompaniment impartment operation carried out by the additional value generation section S2 of the server 3. At step C1 of this left-hand accompaniment impartment operation, the input melody is analyzed so as to generate data indicative of the musical key and/or chord progression of the input melody. At next step C2, a left-hand accompaniment style is decided on the basis of the additional-value-data generating parameters (e.g., those concerning the parameter type "Style") input on the "Parameter 2" input screen. At following step C3, left-hand accompaniment data to be imparted are generated on the basis of the generated musical key data and/or chord progression data, input additional-value-data generating parameters (e.g., tone volume and pitch range (octave) and decided left-hand accompaniment style. For example, the left-hand accompaniment data are generated here by modifying a basic accompaniment pattern, corresponding to the style, so as to conform to the musical key and/or chord progression and then adjusting the tone volume and pitch range of the basic accompaniment pattern. Thus, with this left-hand accompaniment impartment operation, it is possible to impart a left-hand performance part appropriate to the input melody set as the right-hand performance part.

Figure 11:
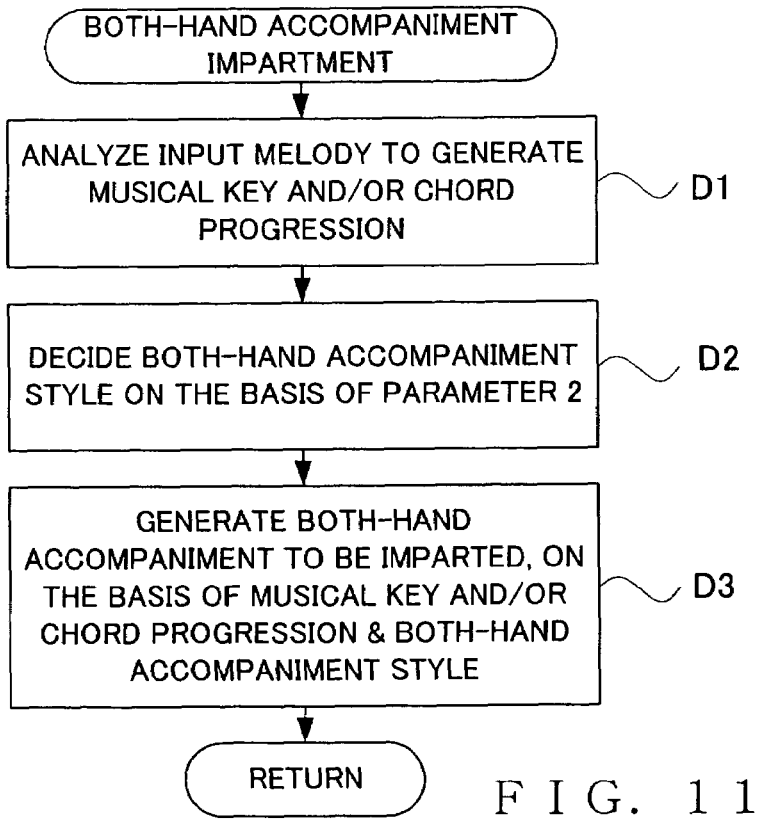
FIG. 11 is a flow chart showing an example of a both-hand accompaniment impartment operation carried out by the additional value generation section.

(4) Both-hand Accompaniment Impartment Operation:

FIG. 11 is a flow chart showing an example of the both-hand accompaniment impartment operation carried out by the additional value generation section S2. At first step D1 of this both-hand accompaniment impartment operation, the input melody is analyzed so as to generate data indicative of the musical key and/or chord progression of the input melody. At next step D2, a both-hand accompaniment style is decided on the basis of the additional-value-data generating parameters (e.g., those concerning the parameter type "Style") input on the "Parameter 2" input screen. At following step D3, both-hand accompaniment data to be imparted are generated on the basis of the generated musical key data and/or chord progression data, input additional-value-data generating parameters (e.g., tone volume and pitch range (octave)) and decided both-hand accompaniment style. For example, the both-hand accompaniment data are generated here by modifying a basic accompaniment pattern, corresponding to the style, so as to conform to the musical key and/or chord progression and then adjusting the tone volume and pitch range of the basic accompaniment pattern. Thus, with this both-hand accompaniment impartment operation, it is possible to impart a both-hand performance part appropriate to the input melody.

Figure 12:
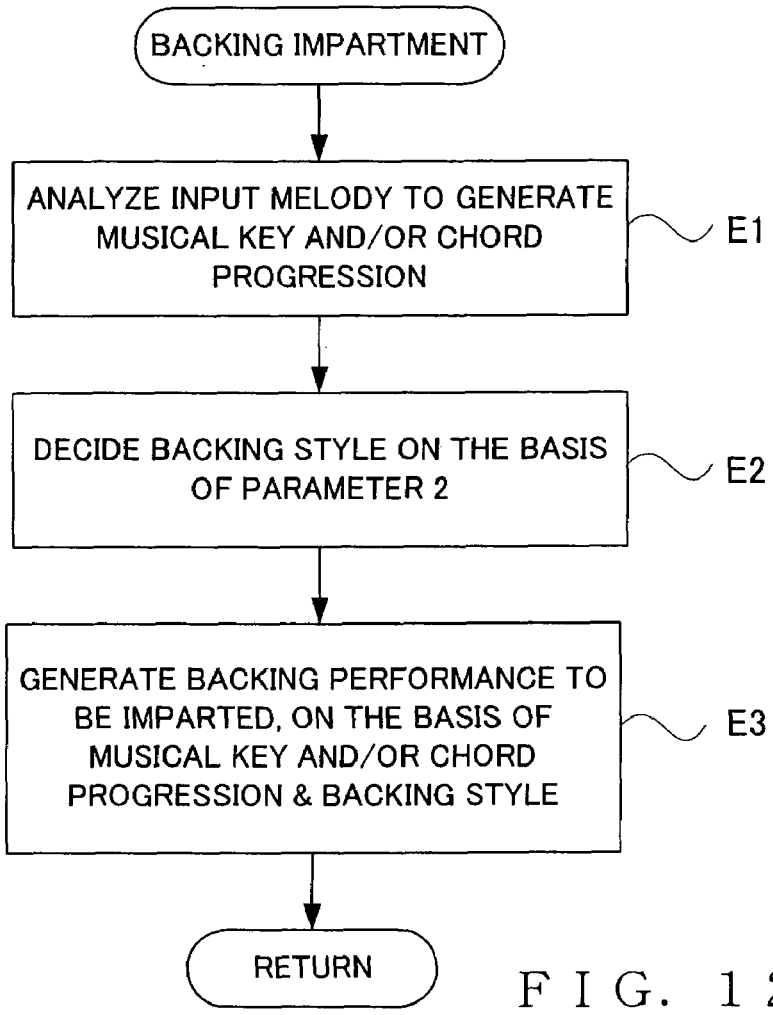
FIG. 12 is a flow chart showing an example of a backing impartment operation carried out by the additional value generation section.

(5) Backing Impartment Operation:

FIG. 12 is a flow chart showing an example of the backing impartment operation carried out by the additional value generation section S2. At first step E1 of this backing impartment operation, the input melody is analyzed so as to generate data indicative of the musical key and/or chord progression of the input melody. At next step E2, a backing style is decided on the basis of the additional-value-data generating parameters input on the "Parameter 2" input screen. At following step E3, backing data to be imparted are generated on the basis of the generated musical key data and/or chord progression data and decided backing style. For example, the backing data are generated here by modifying a basic backing pattern, corresponding to the style, so as to conform to the musical key and/or chord progression and then adjusting the tone volume and pitch range of the basic accompaniment pattern. Thus, with this backing impartment operation, it is possible to impart rhythm, bass and chord backing (band performance) appropriate to the input melody.

Figure 13:
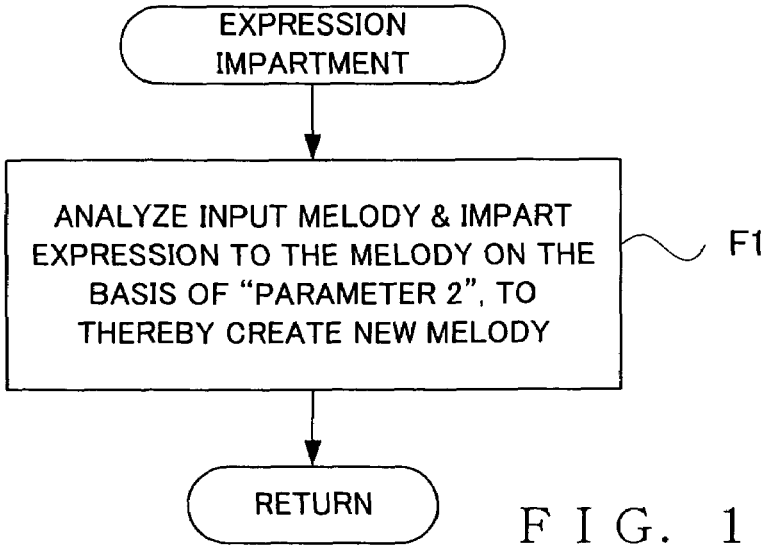
FIG. 13 is a flow chart showing an example of a performance expression impartment operation carried out by the additional value generation section.

(6) Performance Expression Impartment Operation:

FIG. 13 is a flow chart showing an example of the performance expression impartment operation carried out by the additional value generation section S2. At step F1 of this performance expression impartment operation, the input melody is analyzed, and performance expressions, such as a vibrato, are imparted to the melody on the basis of the additional-value-data generating parameters input on the "Parameter 2" input screen, to thereby create a new melody. For this purpose, a performance expression imparting algorithm may be prestored in memory so that an expression-imparted melody is generated by applying the input melody and additional-value-data generating parameters to the performance expression imparting algorithm. Thus, with this performance expression impartment operation, it is possible to impart performance expressions to the simple input melody.

Figure 14:
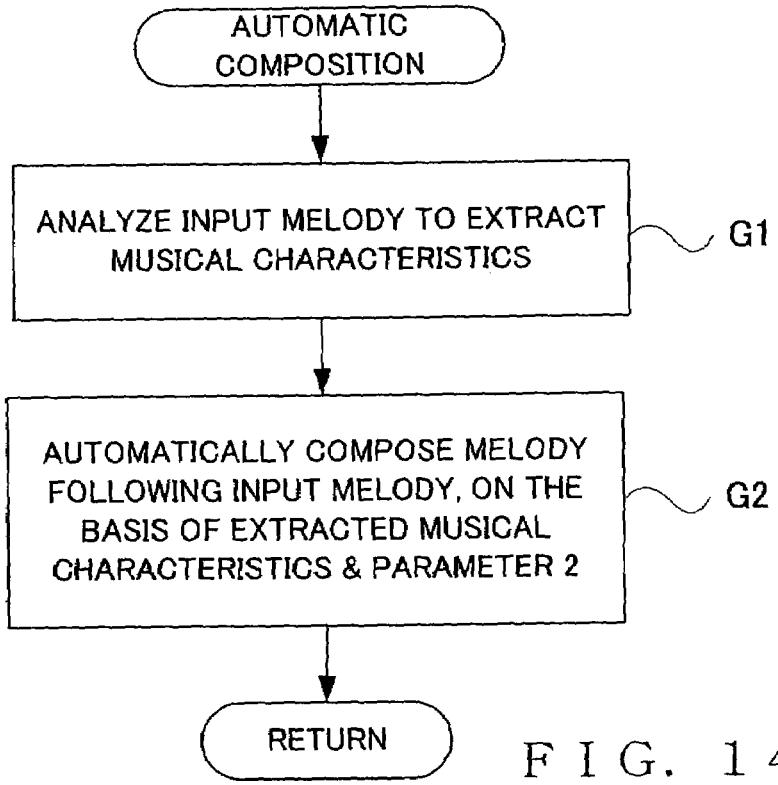
FIG. 14 is a flow chart showing an example of an automatic composition operation carried out by the additional value generation section.

(7) Automatic Composition Operation:

FIG. 14 is a flow chart showing an example of the automatic composition operation carried out by the additional value generation section S2 of the server 3. At step G1 of this automatic composition operation, the input melody (e.g., first two measures of the input melody) is analyzed so as to extract musical characteristics of the melody. Then, at step G2, a melody that should follow the input melody is automatically composed on the basis of the extracted musical characteristics of the input melody and additional-value-data generating parameters input on the "Parameter 2" input screen, to thereby create a new melody. For this purpose, a melody generating algorithm may be prestored in memory so that a new melody is generated by applying the extracted musical characteristics and additional-value-data generating parameters to the performance expression imparting algorithm. Thus, with this automatic composition operation, it is possible to generate a melody of a single complete music piece using the input melody as a motif.

Figure 15:
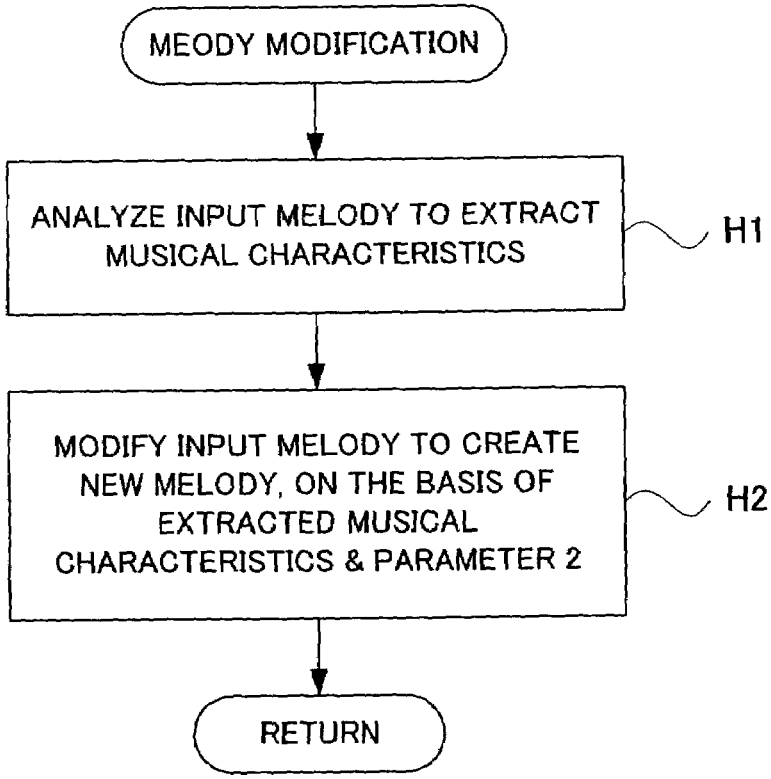
FIG. 15 is a flow chart showing an example of a melody modification operation carried out by the additional value generation section.

(8) Melody Modification Operation:

FIG. 15 is a flow chart showing an example of the melody modification operation carried out by the additional value generation section S2. At step H1 of this automatic composition operation, the input melody (e.g., first two measures of the input melody) is analyzed so as to extract musical characteristics of the melody. Then, at step H2, the input melody is modified to create a new melody, for example, by randomly changing non-skeletal or non-chord-component tones of the input melody to other kinds of tones or into another similar rhythm on the basis of the extracted musical characteristics and additional-value-data generating parameters input on the "Parameter 2" input screen. Thus, with this melody modification operation, it is possible to generate a melody analogous to the input melody.

Figure 16:
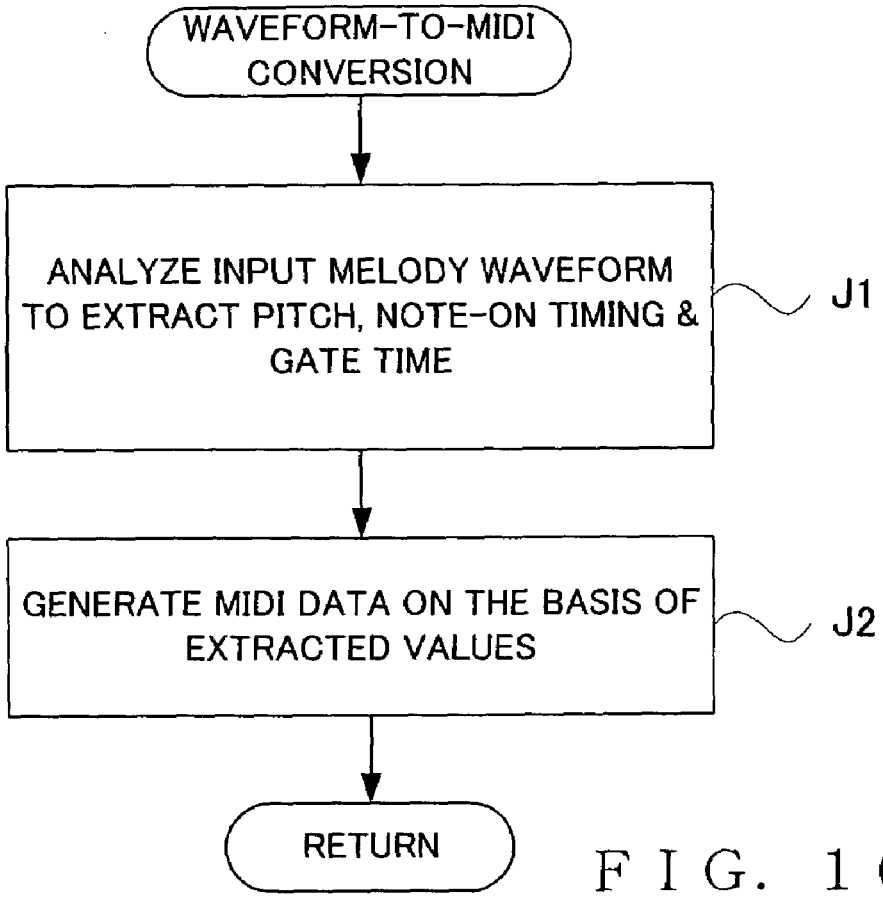
FIG. 16 is a flow chart showing an example of a waveform-to-MIDI conversion operation carried out by the additional value generation section.

(9) Waveform-to-MIDI Conversion Operation:

FIG. 16 is a flow chart showing an example of the waveform-to-MIDI conversion operation carried out by the additional value generation section S2. At step J1 of this waveform-to-MIDI conversion operation, a tone waveform of a melody, input by picking up humming or the like, is analyzed so as to extract values of tone pitches, note-on timing and gate time of the input melody. Then, at step J2, music piece data of a predetermined format, such as the MIDI format, are generated on the basis of the extracted values. Note that the format of the music piece data may be other than the MIDI format, such as the tone-generator-driving performance data format as used in cellular phones (for generating melody sound), electronic game apparatus, etc. Thus, with this waveform-to-MIDI conversion operation, it is possible to generate music piece data of a predetermined format, such as the MIDI format, which correspond to the input waveform data of the melody.

Figure 17:
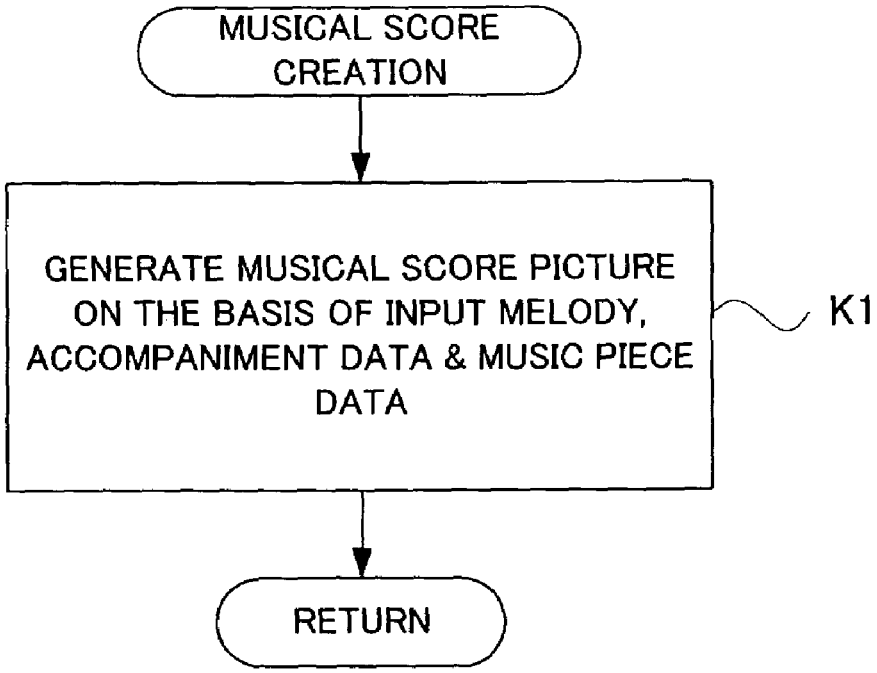
FIG. 17 is a flow chart showing an example of a musical score creation operation carried out by the additional value generation section.

(10) Musical Score Creation Operation:

FIG. 17 is a flow chart showing an example of the musical score creation operation carried out by the additional value generation section S2. At step K1 of this musical score creation operation, a picture of a musical score is generated on the basis of the melody, accompaniment data, music piece data, etc. generated by one or more of the operations described in items (1) to (9) above. Thus, with this musical score creation operation, it is possible to convert the additional-value-imparted musical data into musical score data.

<Modified Embodiment>

As a modification of the melody input, a polyphonic melody or a melody with an accompaniment attached thereto, rather than a monophonic melody, may be input by the user to the client terminal 1 or 2. In such a case, the additional value generation section S2 may be arranged to generate an additional value using any of operations described in items (11) to (13) below; in this way, chords can be generated with higher precision than in the case of the monophonic melody.

(11) Harmony re-impartment operation for deleting the original harmonies and imparting therefor other harmonies matching with the input melody (main melody).

(12) Accompaniment re-impartment operation for deleting the original accompaniment and imparting therefor another accompaniment matching with the input melody.

(13) Chord impartment operation for imparting chords in response to input of a tone waveform of a polyphonic melody or accompaniment-imparted melody.

Whereas the content generation service system of the present invention has been described above in relation to the case where a melody is input as a musical material, any other musical material than a melody, such as chord progression, may be used. For example, the additional value generation section S2 of the server 3 may have a function for automatically composing a monophonic or polyphonic melody in response to input of chord progression data and melody generating parameters, and/or a function for generating accompaniment data in response to input of chord progression data and accompaniment generating parameters. In an alternative, the additional value generation section S2 of the server 3 may have a function for automatically composing a monophonic or polyphonic melody in response to input of only melody generating parameters.

Figure 18:
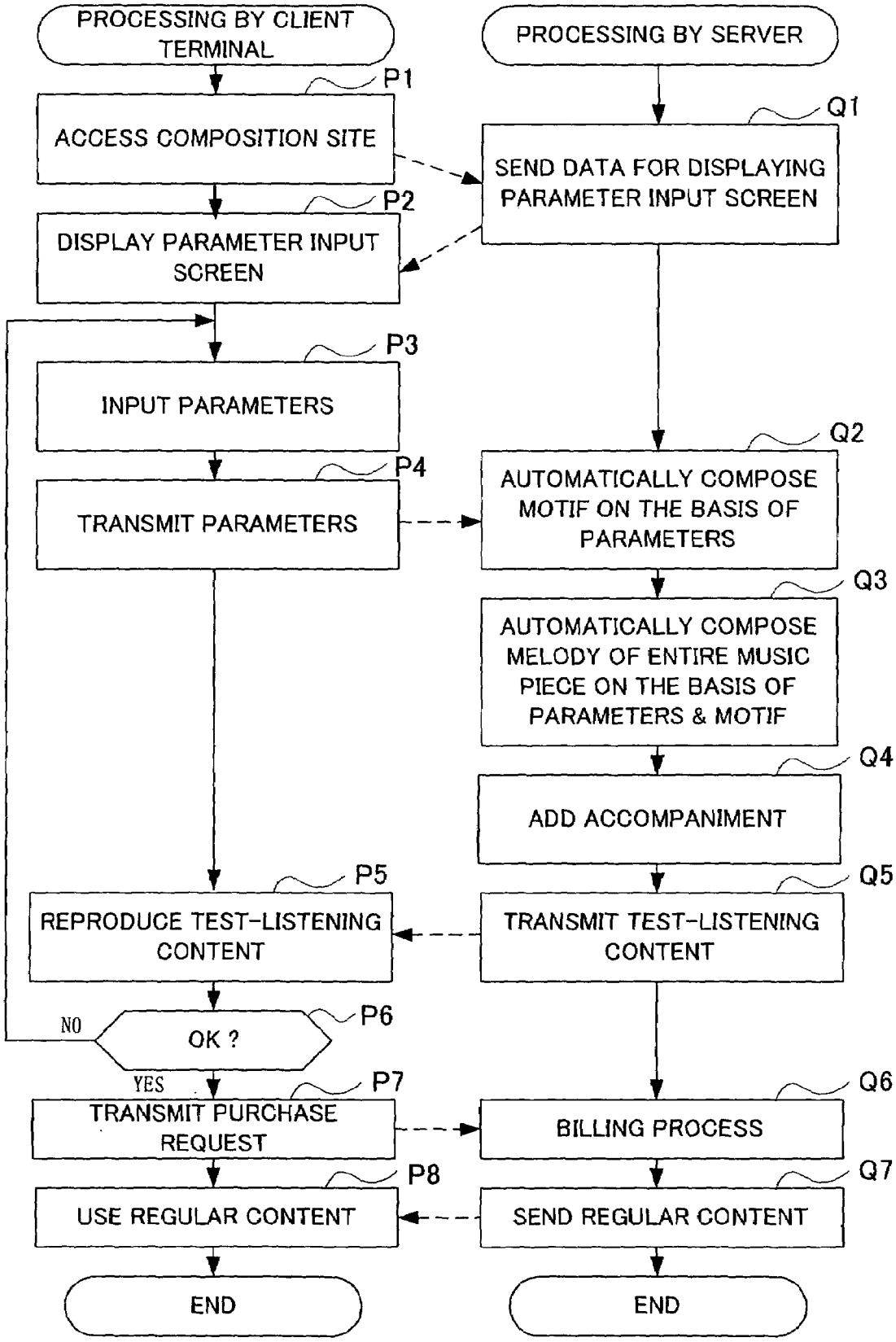
FIG. 18 is a flow chart illustrating processes carried out by the client terminal and server for automatically composing a melody in the embodiment of the content generation service system.

FIG. 18 is a flow chart illustrating processes carried out by the client terminal 1 or 2 and server 3 for automatically composing a melody. In the illustrated example, only melody generating parameters are input via the client terminal 1 or 2 and transmitted to the server 3, so that the server 3 automatically composes a melody only on the basis of the received melody generating parameters.

In the illustrated example of FIG. 18, the client terminal 1 or 2 first accesses a composition site provided in the server 3, at step P1. Specifically, the client terminal 1 or 2 transmits the URL (Uniform Resource Locator) of the composition site to the server 3. In response to such access from the client terminal 1 or 2, the server 3, at step Q1, transmits data for displaying a parameter input screen to the client terminal 1 or 2. Then, upon receipt of the input-screen displaying data from the server 3, the client terminal 1 or 2 displays the parameter input screen on its display device 22, at step P2.

Figure 19:
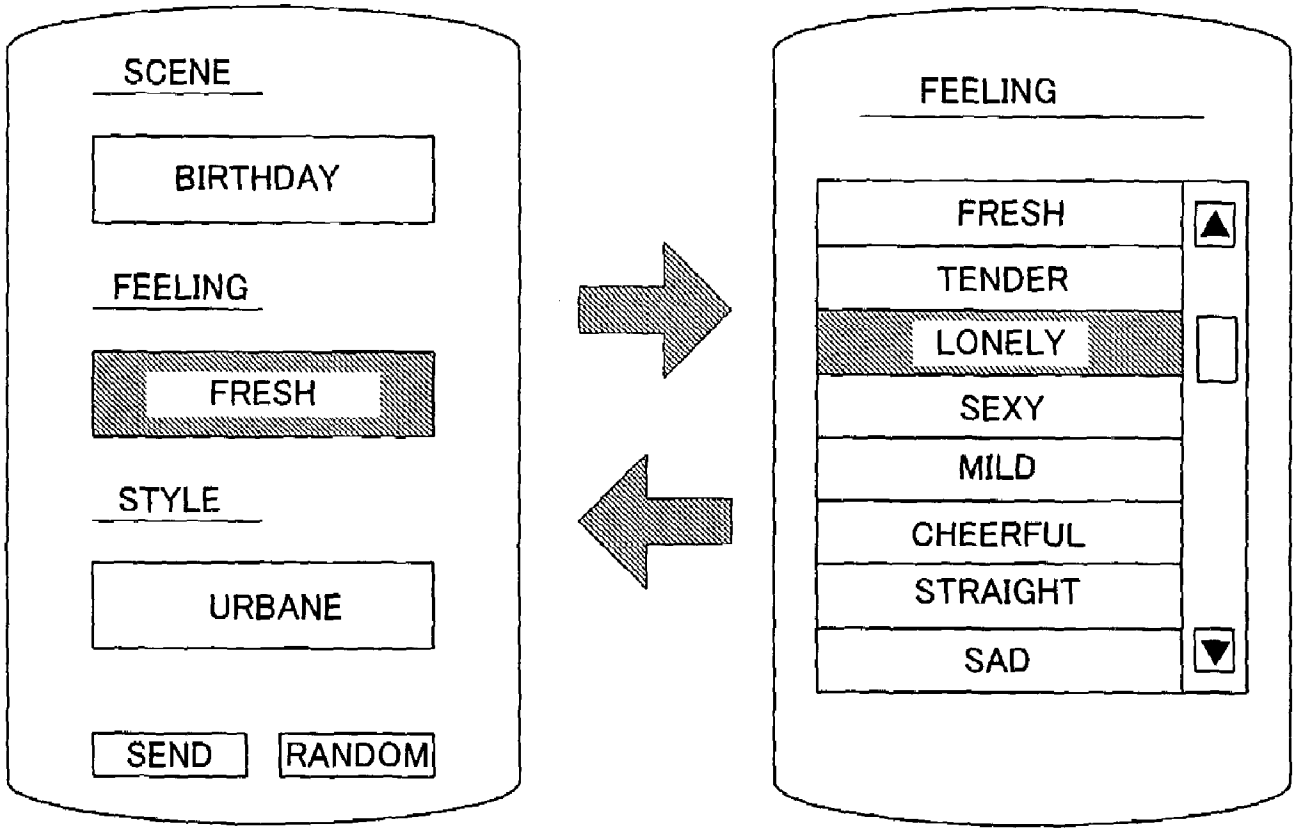
FIG. 19 is a diagram showing an example of a parameter input screen for use in automatic composition of a melody in the embodiment of the content generation service system.

FIG. 19 is a diagram showing an example of the parameter input screen, which is a screen for the user to select and enter one of a plurality types of parameters. In FIG. 19, "Scene", "Feeling" and "Style" are shown as the plurality types of parameters. The parameter type "Scene" represents parameters for designating a scene where a music piece is presented, and specific examples belonging to this parameter type "Scene" include "Birthday" and "Christmas Day". The parameter type "Feeling" represents parameters for designating a feeling or atmosphere of an automatically composed music piece, and specific examples belonging to this parameter type "Feeling" include "Fresh" and "Tender". Further, the parameter type "Style" represents parameters for designating an accompaniment of a music piece, and specific examples belonging to this parameter type "Style" include "Urbane" and "Earthy".

For example, when the user selects a desired one of the parameter types by moving a cursor, depicted in section (A) of FIG. 19 by a hatched rectangular block, to the position of the desired parameter type through manipulation of a predetermined operator (e.g. up/down switch) of the on the operator unit 21 and giving a "Decision" instruction at a predetermined position (such as by activating or clicking an "Enter" switch), choices of specific parameters belonging to the selected parameter type are displayed as shown in section (B) of FIG. 19. Then, once the user selects a desired one (in the illustrated example, "Lonely") of the parameters by moving the cursor to the position of the desired parameter through manipulation of a predetermined operator on the operator unit 21 and giving a "Decision" instruction at a predetermined position, the selected parameter of the selected parameter type (in the illustrated example, "Feeling") is finally set, after which the screen returns to the display state of section (A) of FIG. 19. Similar instructions are given by the user for all the parameter types, so as to set parameters for automatically composing a music piece. When a "Random" button shown at the lower right on the screen shown in section (A) of FIG. 19 is activated or clicked by user's manipulation on the operator unit 21, any one of the parameters is decided randomly for each of the parameter types.

Once parameters have thus been decided for all of the parameter types, the user manipulates the operator unit 21 to activate or click a "Send" button at the lower left on the screen shown in section (A) of FIG. 19, so as to transmit each of the selected parameters to the server 3. In turn, at step Q2, the server 3 automatically composes a motif melody having one or more measures on the basis of the parameters received from the client terminal 1 or 2. More specifically, the server 3 has prestored therein, for each of the selectable parameters, a set of detailed parameters (such as rhythm- and pitch-related parameters) to be used for automatic composition, so that a motif melody can be automatically composed by the server 3 selecting some of the sets of detailed parameters corresponding to the received parameters and supplying the selected sets of detailed parameters to an automatic composition engine.

After having completed the automatic composition of the motif melody, the server 3 goes to next step Q3, where a melody of an entire music piece is automatically composed using the automatic composition engine and on the basis of the detailed parameter sets corresponding to the received parameters and the motif melody composed at step Q2 above. Then, at following step Q4, an accompaniment part for the entire music piece is generated with respect to the melody of the entire music piece using the automatic composition engine, and the thus-generated accompaniment part is imparted to the melody.

Examples of the automatic composition engine and detailed parameter sets as mentioned above are described in detail in U.S. patent application Ser. No. 09/449,715 corresponding to Japanese Patent Application Laid-open No.

2000-221976 filed by the same assignee of the instant application. In a situation where the number of tones simultaneously generatable in the client terminal 1 or 2 is limited and differs (such as one, three or four tones) depending on the type of the client terminal, it is preferable to employ a scheme in which information indicative of the number of tones simultaneously generatable in the client terminal and type of the client terminal is included previously in the parameters so that the automatic composition engine generates a specific number of tones corresponding to such information. Examples of the scheme may include: one where no accompaniment part is imparted if only one tone is simultaneously generatable in the client terminal; one where two accompaniment parts are imparted if three tones are simultaneously generatable in the client terminal; and one where three accompaniment parts are imparted if four tones are simultaneously generatable in the client terminal.

After the melody and accompaniment part for the entire music piece have been automatically composed at step Q3 and Q4, the server 3 proceeds to step Q5, in order to create test-listening content comprising a part of the composed music piece data set and send the thus-created test-listening content to the client terminal 1 or 2. Specifically, the test-listening content may comprise only the motif melody, only the melody of the entire music piece, only the accompaniment, only the music piece data up to a halfway point of the entire music piece, or the like.

Then, at step P5, the client terminal 1 or 2 receives the test-listening content from the server 3 and reproduces the received test-listening content. At next step P6, the client terminal 1 or 2 makes a determination as to whether the music piece data corresponding to the test-listening content, i.e. the regular content, is to be purchased or not. If it has been determined, as a result of the test listening, that the regular content is to be purchased (YES determination), then the client terminal 1 or 2 goes on to step P7, where a purchase request for the regular content is transmitted to the server 3 by manipulation of the operator unit 21. If, on the other hand, the regular content is not to be purchased, i.e. if the automatic composition is to be re-executed (NO determination), the client terminal 1 or 2 loops back to step P3 so as to re-execute the automatic composition starting with display, on the display device 22, of the parameter input screen. There may be employed another alternative in which the automatic composition is not re-executed at all even when the user does not want to purchase the regular content.

Upon receipt of the purchase request from the client terminal 1 or 2, the server 3 carries out the billing process at step Q6 and then sends the regular content to the client terminal 1 or 2. Then, at step P8, the client terminal 1 or 2 uses the received regular content for generation of an incoming-call alerting melody, BGM during a call, or the like.

It should be also appreciated that the regular content purchased or obtained in the above-mentioned manner may be imparted with a further additional value through the above-described additional value service. For example, a picture of a musical score corresponding to the regular content may be obtained, or the accompaniment part contained in the regular content may be deleted so as to impart harmonies, left-accompaniment, both-hand accompaniment, backing or the like to the regular content in place of the accompaniment part.

<Modifications>

It should be obvious that the content generation service system of the present invention having been described above may be modified variously. For example, the data transmission from the client personal computer or portable communication terminal to the server, or the data delivery from the server to the client personal computer or portable communication terminal may be performed in any desired manner; the data may be transmitted or delivered by use of the HTTP (HyperText Transfer Protocol), FTP (File Transfer Protocol), by being attached to an electronic mail or by being sent by ordinary mail.

Further, the data to be communicated in the present invention may be of any desired format. For example, the music piece data may be based on the MIDI standard (e.g., SMF: Standard MIDI File) or other format (e.g., format specific to the maker or manufacturer). The musical score data may be image data (e.g., bit map), may be of any other suitable format (e.g., file format capable of being handled by predetermined score-creating or score-displaying software), may be electronic data, or may be printed on a sheet of paper or the like; if the musical score data are electronic data, they may be either in a compressed form or in a non-compressed form. Furthermore, the data may be encrypted or imparted with an electronic signature. Moreover, the data format of content may be selected as desired by the user, and data of a plurality of formats may be delivered simultaneously.

It should also be appreciated that the musical data to be provided as content may be organized in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event.

In summary, the present invention having been described so far is characterized in that musical material information, such as original melody information, is input via a client terminal like a client personal computer or portable communication terminal and transmitted to a server so that the server generates music piece data having an additional value imparted thereto (additional-value-imparted data) and delivers the generated music piece data (additional-value-imparted data) to the client terminal. With such a arrangement, the present invention allows the user of the client terminal to obtain additional-value-imparted content without having to complicate the structure of the client terminal.

Further, according to the present invention, the server is arranged to generate test-listening or test-viewing content (sample data) in addition to regular content (additional-value-imparted data), and the client terminal is arranged to test-listen or test-view the test-listening or test-viewing content (sample data) and obtain or purchase the regular content (additional-value-imparted data) if the user has found the sample content to be satisfactory as a result of the test listening or test viewing. Thus, in case the sample content generated and delivered by the server has been found unsatisfactory, the user can choose to not purchase the corresponding regular content.

Further, because parameters (control data) are input, along with musical material information (original melody information), via the client terminal and then the server generates content (additional-value-imparted data) on the basis of the musical material information (original melody information) and parameters (control data), the user of the client terminal can control the substance of the to-be-generated content (additional-value-imparted data) in accordance with parameters (control data) input by the user, to thereby obtain desired content (additional-value-imparted data) in accordance with parameters (control data).

Furthermore, according to the present invention, the server is arranged in such a manner that when parameter information, such as melody generating parameters, is input via the client terminal and transmitted to the server, the server generates musical content, such as a melody, on the basis of the parameter information from the client terminal and delivers the thus-generated musical content to the client terminal. With this arrangement, the user of the client terminal can obtain musical content with great facility.

What is claimed is:

1. A client terminal for generating content, said client terminal operatively coupled to a server over a bi-directional communication network, said client terminal comprising:

an input device adapted for inputting melody information, said melody information including musical content data of a melody;

a transmitter operatively coupled with said input device and adapted to transmit the inputted melody information to the coupled server; and a receiver adapted to receive content information from the server, said content information having been created by the server on the basis of the melody information, transmitted by the transmitter, wherein said content information includes at least one of:

harmony information matching with the input melody information transmitted via said transmitter, backing information matching with the input melody information, left-hand performance information matching with the input melody information, with the input melody information assumed to be performance information generated through a performance on a keyboard-based musical instrument with a right hand, both-hand performance information matching with the input melody information, performance expression information for the input melody information, musical composition information of a single music piece with the input melody information used as a motif thereof, other melody information made by modifying the input melody information, information made by converting waveform data of the input melody information into tone-generator driving information of a predetermined format, and musical score picture information corresponding to at least one of the information listed above.

2. A client terminal as claimed in claim 1 wherein the content information received via said receiver is sample content information that is intended for test listening or test viewing, said transmitter is further adapted to transmit, to the server, a request for delivery of regular content information, and said receiver is adapted to receive the regular content information delivered from the server in response to the request for delivery.

3. A client terminal as claimed in claim 1 wherein said input device is further adapted to input parameter information to said client terminal, said transmitter is further adapted to transmit the parameter information, inputted via said input device, to the server, and said receiver is further adapted to receive, from the server, the content information corresponding to the parameter information transmitted via said transmitter to the server.

4. A client terminal as claimed in claim 3 wherein the parameter information is inputted via said input device by being selected from among a plurality of items of previously-provided parameter information.

5. A client terminal as claimed in claim 1 wherein the melody information inputted by said input device is either a series of note data or waveform data.

6. A client terminal as claimed in claim 1 wherein said input device is one of an input device for inputting note data in response to designation of a musical score displayed on a display, an input device for loading and inputting music piece data stored in a storage device, and an input device for inputting waveform data.

7. A client terminal as claimed in claim 1 wherein the content information received by said receiver further includes musical score data pertaining to the melody information.

8. A server for generating content, said server operatively coupled to a client terminal over a bi-direction communication network, said server comprising:

a receiver adapted to receive melody information from the client terminal, said melody information including musical content data of a melody;

a processor device coupled with said receiver and adapted to create content information on the basis of the received melody information, said content information including at least one of:

harmony information matching with the melody information received via said receiver;

backing information matching with the received melody information, left-hand performance information matching with the received melody information, with the received melody information assumed to be performance information generated through a performance on a keyboard-based musical instrument by a right hand, both-hand performance information matching with the received melody information;

performance expression information for the received melody information, musical composition information of a single music piece with the received melody information used as a motif thereof, other melody information made by modifying the received melody information, information made by converting waveform data of the received melody information into tone-generator driving information of a predetermined format, and musical score picture information corresponding to at least one of the information listed above; and a delivery device operatively coupled with said processor device and adapted to deliver, to the client terminal, the content information created by said processor device.

9. A server as claimed in claim 8 wherein said processor device is adapted to create said content information as one of regular content information and sample content information that is intended for test listening or test viewing, and said delivery device delivers, to the client terminal, the sample content information created by said processor device, and, in response to a request for delivery of the regular content information by the client terminal, delivers, to the client terminal, the regular content information created by said processor device.

10. A server as claimed in claim 9 which further comprises a device for performing a billing process on the basis of the request for delivery of the regular content information by the client terminal.

11. A server as claimed in claim 8 wherein said receiver is further adapted to receive parameter information from the client terminal, and said processor device is adapted to create the content information including music information corresponding to the parameter information received via said receiver.

12. A server as claimed in claim 8 where the melody information received by said receiver is either a series of note data or waveform data.

13. A server as claimed in claim 8 wherein the content information created by said processor device further includes musical score data pertaining to the melody information.

14. In a system having a server and a client terminal, said server and said client terminal being operatively coupled over a bi-directional communication network, a method for generating content information, said method comprising:

a step of inputting melody information, said melody information including musical content data of a melody;

a step of transmitting the inputted melody information to the server; and a step of receiving content information from the server, said content information having been created by the server on the basis of the melody information, transmitted by said step of transmitting, wherein said content information includes at least one of:

harmony information matching with the input melody information transmitted via said transmitter, backing information matching with the input melody information, left-hand performance information matching with the input melody information, with the input melody information assumed to be performance information generated through a performance on a keyboard-based musical instrument with a right hand, both-hand performance information matching with the input melody information, performance expression information for the input melody information, musical composition information of a single music piece with the input melody information used as a motif thereof, other melody information made by modifying the input melody information, and information made by converting waveform data of the input melody information into tone-generator driving information of a predetermined format; and musical score picture information corresponding to at least one of the information listed above.

15. In a system having a server and a client terminal, said server and said client terminal being operatively coupled over a bi-directional communication network, a method for generating content information using the server, said method comprising:

a step of receiving melody information from the client terminal, said melody information including musical content data of a melody;

a step of creating content information on the basis of the received melody information, said content information including at least one of:

harmony information matching with the input melody information transmitted via said transmitter, backing information matching with the input melody information, left-hand performance information matching with the input melody information, with the input melody information assumed to be performance information generated through a performance on a keyboard-based musical instrument with a right hand, both-hand performance information matching with the input melody information, performance expression information for the input melody information, musical composition information of a single music piece with the input melody information used as a motif thereof, other melody information made by modifying the input melody information, information made by converting waveform data of the input melody information into tone-generator driving information of a predetermined format, and musical score picture information corresponding to at least one of the information listed above; and a step of delivering, to the client terminal, the content information created by said step of creating.

16. A program containing a group of instructions to cause a computer of a client terminal to perform a method for generating content, said client terminal operatively coupled to a server over a bi-directional communication network, said method comprising:

a step of inputting melody information, said melody information including musical content data of a melody;

a step of transmitting to the server the inputted melody information; and a step of receiving from the server content information created by the server, said content information having been created by the server on the basis of the melody information, transmitted by said step of transmitting, wherein said content information includes at least one of:

harmony information matching with the input melody information transmitted via said transmitter, backing information matching with the input melody information, left-hand performance information matching with the input melody information, with the input melody information assumed to be performance information generated through a performance on a keyboard-based musical instrument with a right hand, both-hand performance information matching with the input melody information, performance expression information for the input melody information, musical composition information of a single music piece with the input melody information used as a motif thereof, other melody information made by modifying the input melody information, and information made by converting waveform data of the input melody information into tone-generator driving information of a predetermined format; and musical score picture information corresponding to at least one of the information listed above.

17. A program containing a group of instructions to cause a computer of a server to perform a method for generating content, said server operatively coupled to a client terminal over a bi-directional communication network, said method comprising:

a step of receiving melody information from the client terminal, said melody information including musical content data of a melody;

a step of creating content information on the basis of the received melody information, said content information including at least one of:

harmony information matching with the input melody information transmitted via said transmitter, backing information matching with the input melody information, left-hand performance information matching with the input melody information, with the input melody information assumed to be performance information generated through a performance on a keyboard-based musical instrument with a right hand, both-hand performance information matching with the input melody information, performance expression information for the input melody information, musical composition information of a single music piece with the input melody information used as a motif thereof, other melody information made by modifying the input melody information, information made by converting waveform data of the input melody information into tone-generator driving information of a predetermined format, and musical score picture information corresponding to at least one of the information listed above; and a step of delivering, to the client terminal, the content information created by said step of creating.

* * * * *